US007148631B2

(12) United States Patent
Adachi

(10) Patent No.: US 7,148,631 B2
(45) Date of Patent: Dec. 12, 2006

(54) DRIVE DEVICE AND DRIVE METHOD OF LIGHT EMITTING DISPLAY PANEL

(75) Inventor: Shinobu Adachi, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 129 days.

(21) Appl. No.: 11/048,753

(22) Filed: Feb. 3, 2005

(65) Prior Publication Data

US 2005/0190129 A1 Sep. 1, 2005

(30) Foreign Application Priority Data

Feb. 5, 2004 (JP) ..... 2004-028856

(51) Int. Cl.
*G09G 3/10* (2006.01)

(52) U.S. Cl. ..... 315/169.3; 315/169.4; 348/519; 348/675

(58) Field of Classification Search ..... 315/169.1, 315/169.2, 169.3, 169.4
See application file for complete search history.

(56) References Cited

U.S. PATENT DOCUMENTS 5,296,920 A * 3/1994 Sakaue et al. ..... 348/675
6,630,796 B1 * 10/2003 Tokunaga et al. ..... 315/169.4
6,768,479 B1 * 7/2004 Nakamura ..... 345/60
2003/0151374 A1 * 8/2003 Maede et al. ..... 315/169.3
2003/0189410 A1 * 10/2003 Yamazaki et al. ..... 315/169.1

FOREIGN PATENT DOCUMENTS

JP 2003-288051 10/2003

* cited by examiner

*Primary Examiner*—Trinh Vo Dinh
(74) *Attorney, Agent, or Firm*—Westerman, Hattori, Daniels & Adrian, LLP.

(57) ABSTRACT

After a command signal corresponding to a gradation whose light emission is controlled is outputted from a controller IC 4, based on this, a combination of respectively different intensity conversion data are extracted from a linear data table 11 and a γ correction data table 12. The respective intensity conversion data are analog converted by a first DAC 13 and a second DAC 14, and these are converted into a voltage level of a mean value by resistors R1, R2 and an addition circuit 15. By this voltage level of the mean value, an absorption current in a current mirror circuit 16 is controlled, and as a result, a drive current accompanied by γ correction for the light emitting elements can be obtained by the current mirror circuit 16. The first DAC 13 and the second DAC 14 handle relatively simple intensity conversion data obtained from the linear data table 11 and the γ correction data table 12 and analog convert such data. Therefore, a light emission control circuit accompanied by γ correction can be realized without enlarging the circuit scale.

10 Claims, 7 Drawing Sheets

Fig.7

| GRADATION | TABLE 1 (t1) | TABLE 2 (t2) | MEAN VALUE =(t1+t2)/2 | γ CORRECTION VALUE | DIFFERENCE |
|---|---|---|---|---|---|
| 0 | 0 | 0 | 0 | 0.00 | 0.00 |
| 1 | 1 | 0 | 0.5 | 0.18 | -0.32 |
| 2 | 2 | 0 | 1 | 0.39 | -0.61 |
| 3 | 3 | 0 | 1.5 | 0.62 | -0.88 |
| 4 | 4 | 0 | 2 | 0.88 | -1.12 |
| 5 | 5 | 0 | 2.5 | 1.16 | -1.34 |
| 6 | 6 | 0 | 3 | 1.47 | -1.53 |
| 7 | 7 | 0 | 3.5 | 1.81 | -1.69 |
| 8 | 8 | 0 | 4 | 2.18 | -1.82 |
| 9 | 9 | 0 | 4.5 | 2.57 | -1.93 |
| 10 | 10 | 0 | 5 | 2.99 | -2.01 |
| 11 | 11 | 0 | 5.5 | 3.43 | -2.07 |
| 12 | 12 | 0 | 6 | 3.90 | -2.10 |
| 13 | 13 | 0 | 6.5 | 4.40 | -2.10 |
| 14 | 14 | 0 | 7 | 4.92 | -2.08 |
| 15 | 15 | 0 | 7.5 | 5.47 | -2.03 |
| 16 | 16 | 0 | 8 | 6.05 | -1.95 |
| 17 | 17 | 0 | 8.5 | 6.65 | -1.85 |
| 18 | 18 | 0 | 9 | 7.28 | -1.72 |
| 19 | 19 | 0 | 9.5 | 7.94 | -1.56 |
| 20 | 20 | 0 | 10 | 8.62 | -1.38 |
| 21 | 21 | 0 | 10.5 | 9.33 | -1.17 |
| 22 | 22 | 0 | 11 | 10.06 | -0.94 |
| 23 | 23 | 0 | 11.5 | 10.83 | -0.67 |
| 24 | 24 | 0 | 12 | 11.61 | -0.39 |
| 25 | 25 | 0 | 12.5 | 12.43 | -0.07 |
| 26 | 26 | 0 | 13 | 13.27 | 0.27 |
| 27 | 27 | 1 | 14 | 14.14 | 0.14 |
| 28 | 28 | 2 | 15 | 15.03 | 0.03 |
| 29 | 29 | 2 | 15.5 | 15.95 | 0.45 |
| 30 | 30 | 3 | 16.5 | 16.90 | 0.40 |
| 31 | 31 | 4 | 17.5 | 17.87 | 0.37 |
| 32 | 32 | 5 | 18.5 | 18.87 | 0.37 |
| 33 | 33 | 6 | 19.5 | 19.90 | 0.40 |
| 34 | 34 | 7 | 20.5 | 20.95 | 0.45 |
| 35 | 35 | 9 | 22 | 22.03 | 0.03 |
| 36 | 36 | 10 | 23 | 23.14 | 0.14 |
| 37 | 37 | 11 | 24 | 24.27 | 0.27 |
| 38 | 38 | 12 | 25 | 25.43 | 0.43 |
| 39 | 39 | 14 | 26.5 | 26.61 | 0.11 |
| 40 | 40 | 15 | 27.5 | 27.83 | 0.33 |
| 41 | 41 | 17 | 29 | 29.06 | 0.06 |
| 42 | 42 | 18 | 30 | 30.33 | 0.33 |
| 43 | 43 | 20 | 31.5 | 31.62 | 0.12 |
| 44 | 44 | 21 | 32.5 | 32.94 | 0.44 |
| 45 | 45 | 23 | 34 | 34.28 | 0.28 |
| 46 | 46 | 25 | 35.5 | 35.65 | 0.15 |
| 47 | 47 | 27 | 37 | 37.05 | 0.05 |
| 48 | 48 | 29 | 38.5 | 38.47 | -0.03 |
| 49 | 49 | 31 | 40 | 39.92 | -0.08 |
| 50 | 50 | 33 | 41.5 | 41.40 | -0.10 |
| 51 | 51 | 35 | 43 | 42.90 | -0.10 |
| 52 | 52 | 37 | 44.5 | 44.43 | -0.07 |
| 53 | 53 | 39 | 46 | 45.99 | -0.01 |
| 54 | 54 | 41 | 47.5 | 47.57 | 0.07 |
| 55 | 55 | 43 | 49 | 49.18 | 0.18 |
| 56 | 56 | 46 | 51 | 50.81 | -0.19 |
| 57 | 57 | 48 | 52.5 | 52.47 | -0.03 |
| 58 | 58 | 50 | 54 | 54.16 | 0.16 |
| 59 | 59 | 53 | 56 | 55.88 | -0.12 |
| 60 | 60 | 55 | 57.5 | 57.62 | 0.12 |
| 61 | 61 | 58 | 59.5 | 59.39 | -0.11 |
| 62 | 62 | 60 | 61 | 61.18 | 0.18 |
| 63 | 63 | 63 | 63 | 63.00 | 0.00 |

FIG.8

| GRADATION | TABLE 1 (t1) | TABLE 2 (t2) | MEAN VALUE =(t1+t2)/2 | γ CORRECTION VALUE | DIFFERENCE |
|---|---|---|---|---|---|
| 0 | 0 | 0 | 0 | 0.00 | 0.00 |
| 1 | 0 | 0 | 0 | 0.18 | 0.18 |
| 2 | 1 | 0 | 0.5 | 0.39 | -0.11 |
| 3 | 1 | 0 | 0.5 | 0.62 | 0.12 |
| 4 | 2 | 0 | 1 | 0.88 | -0.12 |
| 5 | 2 | 0 | 1 | 1.16 | 0.16 |
| 6 | 3 | 0 | 1.5 | 1.47 | -0.03 |
| 7 | 3 | 0 | 1.5 | 1.81 | 0.31 |
| 8 | 4 | 0 | 2 | 2.18 | 0.18 |
| 9 | 5 | 0 | 2.5 | 2.57 | 0.07 |
| 10 | 6 | 0 | 3 | 2.99 | -0.01 |
| 11 | 7 | 0 | 3.5 | 3.43 | -0.07 |
| 12 | 8 | 0 | 4 | 3.90 | -0.10 |
| 13 | 8 | 0 | 4 | 4.40 | 0.40 |
| 14 | 9 | 0 | 4.5 | 4.92 | 0.42 |
| 15 | 11 | 0 | 5.5 | 5.47 | -0.03 |
| 16 | 12 | 0 | 6 | 6.05 | 0.05 |
| 17 | 13 | 0 | 6.5 | 6.65 | 0.15 |
| 18 | 14 | 0 | 7 | 7.28 | 0.28 |
| 19 | 15 | 0 | 7.5 | 7.94 | 0.44 |
| 20 | 17 | 0 | 8.5 | 8.62 | 0.12 |
| 21 | 18 | 0 | 9 | 9.33 | 0.33 |
| 22 | 19 | 0 | 9.5 | 10.06 | 0.56 |
| 23 | 21 | 0 | 10.5 | 10.83 | 0.33 |
| 24 | 23 | 0 | 11.5 | 11.61 | 0.11 |
| 25 | 24 | 0 | 12 | 12.43 | 0.43 |
| 26 | 26 | 0 | 13 | 13.27 | 0.27 |
| 27 | 27 | 1 | 14 | 14.14 | 0.14 |
| 28 | 28 | 2 | 15 | 15.03 | 0.03 |
| 29 | 29 | 2 | 15.5 | 15.95 | 0.45 |
| 30 | 30 | 3 | 16.5 | 16.90 | 0.40 |
| 31 | 31 | 4 | 17.5 | 17.87 | 0.37 |
| 32 | 32 | 5 | 18.5 | 18.87 | 0.37 |
| 33 | 33 | 6 | 19.5 | 19.90 | 0.40 |
| 34 | 34 | 7 | 20.5 | 20.95 | 0.45 |
| 35 | 35 | 9 | 22 | 22.03 | 0.03 |
| 36 | 36 | 10 | 23 | 23.14 | 0.14 |
| 37 | 37 | 11 | 24 | 24.27 | 0.27 |
| 38 | 38 | 12 | 25 | 25.43 | 0.43 |
| 39 | 39 | 14 | 26.5 | 26.61 | 0.11 |
| 40 | 40 | 15 | 27.5 | 27.83 | 0.33 |
| 41 | 41 | 17 | 29 | 29.06 | 0.06 |
| 42 | 42 | 18 | 30 | 30.33 | 0.33 |
| 43 | 43 | 20 | 31.5 | 31.62 | 0.12 |
| 44 | 44 | 21 | 32.5 | 32.94 | 0.44 |
| 45 | 45 | 23 | 34 | 34.28 | 0.28 |
| 46 | 46 | 25 | 35.5 | 35.65 | 0.15 |
| 47 | 47 | 27 | 37 | 37.05 | 0.05 |
| 48 | 48 | 29 | 38.5 | 38.47 | -0.03 |
| 49 | 49 | 31 | 40 | 39.92 | -0.08 |
| 50 | 50 | 33 | 41.5 | 41.40 | -0.10 |
| 51 | 51 | 35 | 43 | 42.90 | -0.10 |
| 52 | 52 | 37 | 44.5 | 44.43 | -0.07 |
| 53 | 53 | 39 | 46 | 45.99 | -0.01 |
| 54 | 54 | 41 | 47.5 | 47.57 | 0.07 |
| 55 | 55 | 43 | 49 | 49.18 | 0.18 |
| 56 | 56 | 46 | 51 | 50.81 | -0.19 |
| 57 | 57 | 48 | 52.5 | 52.47 | -0.03 |
| 58 | 58 | 50 | 54 | 54.16 | 0.16 |
| 59 | 59 | 53 | 56 | 55.88 | -0.12 |
| 60 | 60 | 55 | 57.5 | 57.62 | 0.12 |
| 61 | 61 | 58 | 59.5 | 59.39 | -0.11 |
| 62 | 62 | 60 | 61 | 61.18 | 0.18 |
| 63 | 63 | 63 | 63 | 63.00 | 0.00 |

DRIVE DEVICE AND DRIVE METHOD OF LIGHT EMITTING DISPLAY PANEL

BACKGROUND OF THE INVENTION

1. Field of the Invention

The present invention relates to a drive device aimed at a passive matrix type display panel in which for example organic EL (electroluminescent) elements are employed as light emitting elements, and particularly to a drive device and a drive method of a light emitting display panel which realizes current drive type gradation control including γ (luminosity factor) correction without increasing the circuit scale.

2. Description of the Related Art

A display panel constructed by arranging light emitting elements in a matrix pattern has been developed widely, and as the light emitting element employed in such a display panel, an organic EL element in which an organic material is employed in a light emitting layer has attracted attention. This is because of backgrounds one of which is that by employing, in the light emitting layer of the element, an organic compound which enables an excellent light emission characteristic to be expected, a high efficiency and a long life which can be equal to practical use have been advanced.

The organic EL element can be electrically replaced by a structure composed of a light emitting component having a diode characteristic and a parasitic capacitance component which is connected in parallel to this light emitting component, and it can be said that the organic EL element is a capacitive light emitting element. When a light emission drive voltage is applied to this organic EL element, at first, electrical charges corresponding to the electric capacity of this element flow into the electrode as displacement current and are accumulated. It can be considered that when the light emission drive voltage then exceeds a predetermined voltage (light emission threshold voltage=Vth) peculiar to this element, current begins to flow from one electrode (anode side of the diode component) to an organic layer constituting the light emitting layer so that the element emits light at an intensity proportional to this current.

Meanwhile, regarding the organic EL element, due to reasons that the voltage-intensity characteristic thereof is unstable with respect to temperature changes while the current-intensity characteristic thereof is stable with respect to temperature changes and that degradation of the organic EL element is considerable when the organic EL element receives excess current so that the light emission lifetime is shortened, and the like, a constant current drive is performed generally. A passive drive type display panel employing such organic EL elements has already been put into practical use partly.

As gradation control methods of the passive drive type display panel, time gradation method in which light emission time during each scan period is controlled to obtain a predetermined gradation and current gradation method in which drive current given to a light emitting element during each scan period is controlled to obtain a predetermined gradation have been proposed. Although either of the gradation control methods described above has advantages and shortcomings respectively, specifically the latter current gradation method has been said to be able to prolong the lifetime of the EL element generally compared to the case where the time gradation method is adopted. The reason is that while control in which an approximately maximum drive current flows is performed at a light emission time of the EL element in the case where the time gradation method is adopted, a chance that a maximum drive current flows rarely occurs in the case of the current gradation method.

Here, in the case where the latter current gradation method is adopted, it is relatively easy to linearly control the drive current value given to the light emitting element in response to a gradation. In this case, for example, a plurality of resistors which have the same resistance value are connected in series or the like to construct so-called ladder resistors so as to draw electrical potentials of respective connection points so that the drive current generated based on these potentials is supplied to the light emitting elements.

However, in the case where current gradation including γ correction is to be realized with the above-described structure, the above-described relatively simple structure cannot satisfy it, and a problem that the circuit scale thereof is considerably large occurs for the following reasons.

That is, FIG. 1 shows one example of a γ correction curve which is suitably adopted in the case where this type of EL element is employed, where the horizontal axis represents gradation and the vertical axis represents light emission intensity. That having been said, an intensity characteristic with respect to ideal gradation in the case where the EL element is employed is based on a correction curve of the order of γ=1.8–2.0.

As understood from the γ correction curve exemplified in this FIG. 1, it is necessary to allow light emission intensity differences for each gradation to be considerably small in a low gradation side and to allow intensity differences for each gradation to be large in a high gradation side. Accordingly, since it is necessary to finely control light emission intensity differences for each gradation particularly in a low gradation side, in the case where this is to be realized in the structure of the aforementioned ladder resistors, it becomes necessary to device means in which a large number of resistors which have slightly different resistance values are prepared so that these resistors, for example, are serial-parallel combined or the like. In that case, a case where switching transistors or the like for performing switching control for the serial-parallel connection relationship are needed may occur, and thus such a circuit structure has to be complex and large-scaled. Further, in the case where a user needs to change a γ correction characteristic, the respective resistors have to be variable.

In order to avoid the above-described problems, a means may be considered wherein the ladder resistors are made relatively simple and a DAC (digital to analog converter) prepared to extract voltage outputs from the ladder resistors is allowed to have the above-described γ correction characteristic. However, in the case where such a means is employed, another problem that the control bit number of the DAC has to be large occurs.

Japanese Patent Application Laid-Open No. 2003-288051 discloses that a current mirror circuit which generates drive current values given to light emitting elements based on the output of the DAC is allowed to have the function of the above-mentioned γ correction characteristic, preventing the ladder resistor combination as described above or the DAC from having a γ correction means.

In a γ correction circuit disclosed in Japanese Patent Application Laid-Open No. 2003-288051, a load resistor of the current mirror circuit is allowed to be variable so that the drive current given to light emitting elements is controlled, thereby providing a γ characteristic. However, referring to the specific γ correction means disclosed in Japanese Patent Application Laid-Open No. 2003-288051, such a means employs a large number of resistors (ladder resistors) and a DAC controlled by several bits are employed together in order to vary the load resistor of the current mirror circuit, and the basic structure thereof does not substantially differ from the one in which the ladder resistors and the DAC are combined.

In the case where a user needs to change a γ correction characteristic, even the structure disclosed in Japanese Patent Application Laid-Open No. 2003-288051 has a problem that a variable resistor or the like has to be prepared separately, and this problem is similar to that of the above-described conventional example.

SUMMARY OF THE INVENTION

The present invention has been developed as attention to the above-described technical problems has been paid, and it is an object of the present invention to provide a drive device and a drive method of a light emitting display panel in which a current gradation method in which the value of drive current given to light emitting elements during each scan period is controlled to obtain a predetermined gradation is adopted so as to realize γ correction with sufficient accuracy for practical use without enlarging the circuit scale.

A preferred aspect of a drive device of a light emitting display panel according to the present invention which has been developed to solve the problems is a drive device of a passive matrix type light emitting display panel comprising a plurality of data lines and a plurality of scan lines which intersect one another and light emitting elements which are respectively connected between the respective data lines and the respective scan lines at intersection positions between the respective data lines and the respective scan lines, characterized by comprising a plurality of intensity conversion data acquisition means for acquiring a combination of respectively different intensity conversion data in response to a gradation whose light emission is controlled, mean value data generation means for generating a mean value of the intensity conversion data respectively acquired by the respective intensity conversion data acquisition means, and drive current supply means for supplying a light emission drive current which can perform gradation control including γ correction for the light emitting elements to the data lines based on mean value data obtained by the mean value data generation means.

A preferred aspect of a drive method of a light emitting display panel according to the present invention which has been developed to solve the problems is a drive method of a passive matrix type light emitting display panel comprising a plurality of data lines and a plurality of scan lines which intersect one another and light emitting elements which are respectively connected between the respective data lines and the respective scan lines at intersection positions between the respective data lines and the respective scan lines, characterized by acquiring a combination of respectively different intensity conversion data set in advance in response to a gradation whose light emission is controlled, generating data of a mean value of these respective intensity conversion data from the respective intensity conversion data, and supplying a light emission drive current which can realize gradation control including γ correction for the light emitting elements based on the data of the mean value.

BRIEF DESCRIPTION OF THE DRAWINGS

FIG. 7 is a table formation showing an example of stored data employed for realizing gradation control accompanied by γ correction; and FIG. 8 is a table formation showing another example of stored data similarly.

DESCRIPTION OF THE PREFERRED EMBODIMENTS

Figure 2:
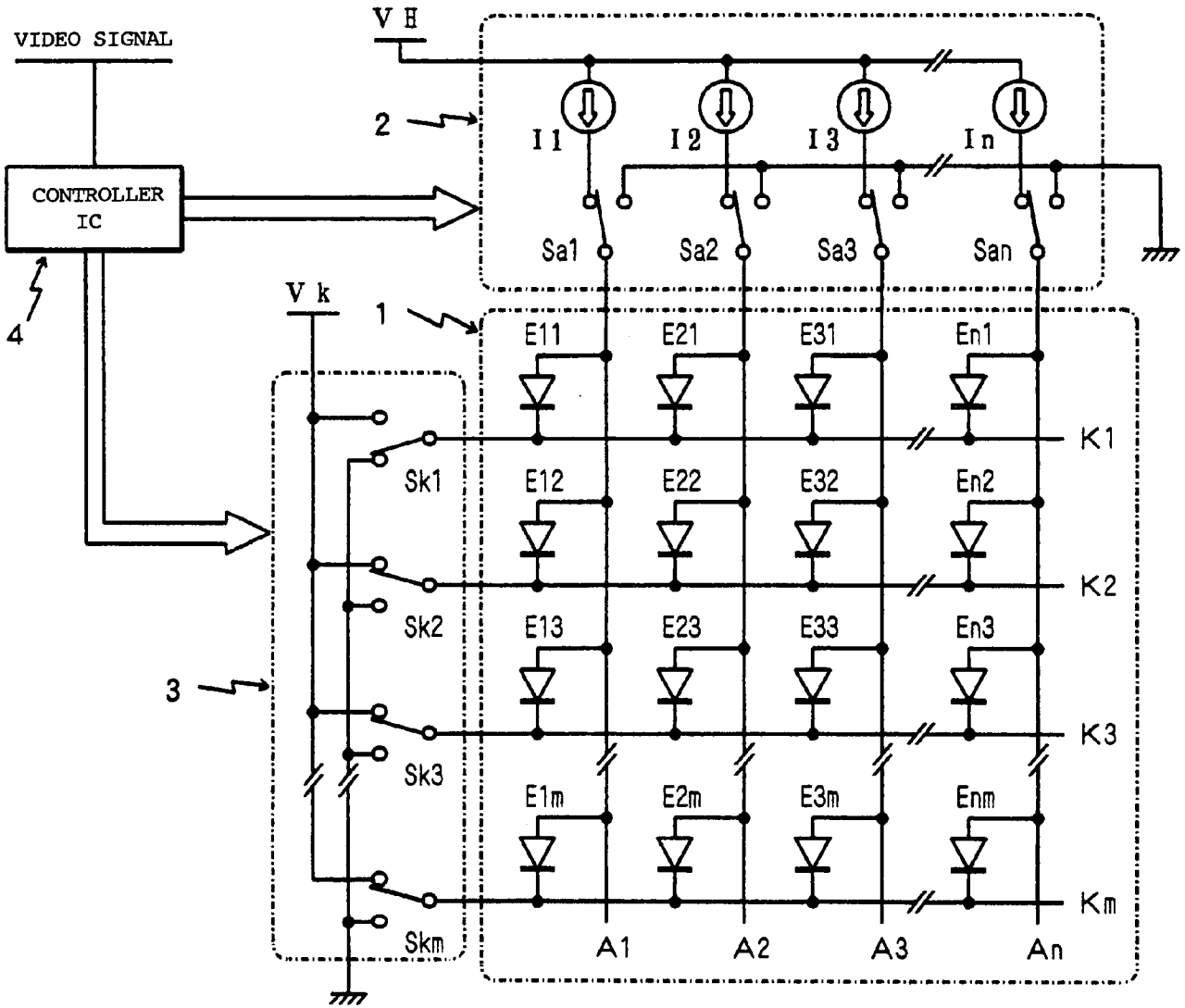
FIG. 2 is a connection diagram showing a passive drive type display panel and a basic structure of a drive device thereof to which the present invention is applied.

A drive device of a light emitting display panel according to the present invention will be described below with reference to the embodiments shown in the drawings. First, FIG. 2 shows a passive drive type display panel to which the present invention is applied and a basic structure of a drive device of the display panel. There are two drive methods for organic EL elements in this passive matrix drive system, that is, cathode line scan/anode line drive and anode line scan/cathode line drive, and the structure shown in FIG. 2 shows an aspect of the former cathode line scan/anode line drive.

That is, anode lines A1–An as n data lines are arranged in a vertical direction, cathode lines K1–Km as m scan lines are arranged in a horizontal direction, and organic EL elements E11–Enm as light emitting elements designated by symbols/marks of diodes are arranged at portions at which the anode lines intersect the cathode lines (in total, n×m portions) to construct a display panel 1.

In the respective EL elements E11–Enm constituting pixels, one ends thereof (anode terminals in equivalent diodes of EL elements) are connected to the anode lines and the other ends thereof (cathode terminals in equivalent diodes of EL elements) are connected to the cathode lines, corresponding to respective intersection positions between the anode lines A1–An extending along the vertical direction and the cathode lines K1–Km extending along the horizontal direction. Further, the respective anode lines A1–An are connected to an anode line drive circuit 2 provided as a data driver, and the respective cathode lines K1–Km are connected to a cathode line scan circuit 3 provided as a scan driver, so as to be driven respectively.

The anode line drive circuit 2 is provided with constant current sources I1–In which utilize a drive voltage VH to be operated and drive switches Sa1–San, and the drive switches Sa1–San are connected to the constant current sources I1–In side so that current from the constant current sources I1–In is supplied to the respective EL elements E11–Enm arranged corresponding to the cathode lines as drive current. When current from the constant current sources I1–In is not supplied to the respective EL elements, the drive switches Sa1–San can allow these anode lines to be connected to a ground side provided as a reference potential point.

Meanwhile, the cathode line scan circuit 3 is equipped with scan switches Sk1–Skm corresponding to the respective cathode lines K1–Km, and these scan switches operate to allow either a reverse bias voltage Vk constituted by a predetermined direct current voltage for mainly preventing cross talk light emission or the ground potential provided as the reference potential point to be connected to corresponding cathode lines. Thus, the constant current sources I1–In are connected to desired anode lines A1–An while the respective cathode lines are sequentially set at the reference potential point (ground potential) at a predetermined cycle, so that the respective EL elements can be selectively illuminated.

A bus line is connected from a controller IC 4 including a CPU to the anode line drive circuit 2 and the cathode line scan circuit 3, and switching operations of the scan switches Sk1–Skm and the drive switches Sa1–San are performed based on a video signal to be displayed. Thus, the cathode scan lines are set to the ground potential at a predetermined cycle as described above based on the video signal, and the constant current sources I1–In are connected to desired anode lines. Accordingly, the respective EL elements are selectively illuminated so that an image based on the video signal is displayed on the display panel 1.

In the state shown in FIG. 2, the first cathode line K1 is set to the ground potential to be in a scan state, and at this time, the reverse bias voltage Vk is applied to the respective cathode lines K2–Km which are in a non–scan state. Thus, the respective EL elements connected at the intersections between the driven anode lines and the cathode lines which are not selected for scanning are prevented from emitting cross talk light.

Figure 3:
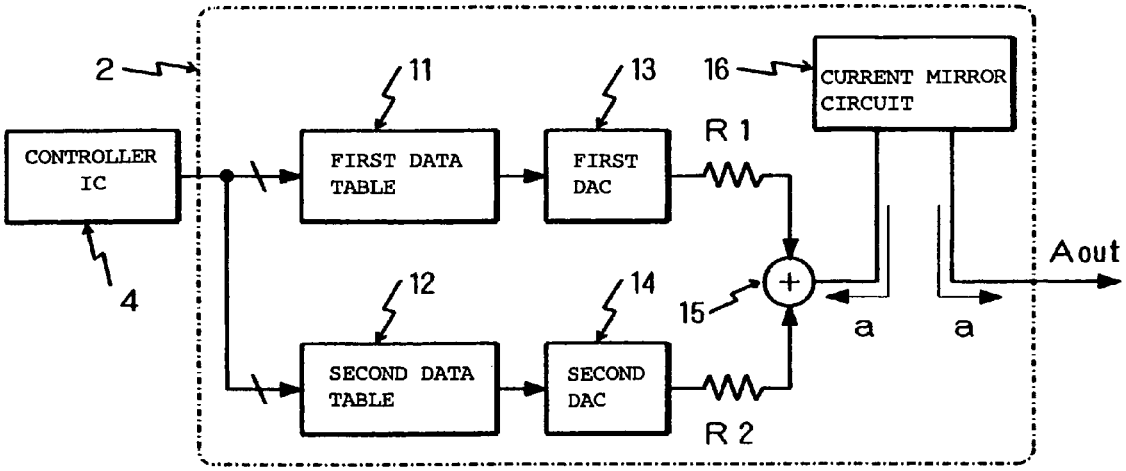
FIG. 3 is a block diagram showing a basic embodiment according to the present invention which realizes gradation control of a current drive method.

FIG. 3 shows an embodiment according to the present invention which realizes gradation control by controlling the drive current supplied to the EL elements arranged in the display panel 1. The controller IC designated by reference numeral 4 in FIG. 3 is the same part shown in FIG. 2, and the data driver (anode line drive circuit) which is enclosed by the dashed line in FIG. 3 and which is designated by reference numeral 2 is also the same part as that shown in FIG. 2.

In the embodiment shown in FIG. 3, in the anode line drive circuit 2, disposed area first data table designated by reference numeral 11 and a second data table designated by reference numeral 12. A command signal corresponding to a gradation whose light emission is controlled is supplied from the controller IC 4 to the first and second data tables 11, 12, and by this supply, a combination of respectively different intensity conversion data are readout of the respective data tables 11, 12. Therefore, the data tables 11, 12 constitute intensity conversion data acquisition means. A specific example of the intensity conversion data in the respective data tables 11, 12 will be explained with reference to FIGS. 7 and 8 later.

The intensity conversion data read out of the first data table 11 is supplied to a first DAC designated by reference numeral 13, and the intensity conversion data read out of the second data table 12 is supplied to a second DAC designated by reference numeral 14. First analog data converted in the first DAC 13 is supplied to an addition circuit 15 via a resistor R1, and second analog data converted in the second DAC 14 is supplied similarly to the addition circuit 15 via a resistor R2.

Therefore, the resistors R1, R2 and the addition circuit 15 constitute addition means which yields a mean value of respective analog data converted by the first and second DAC, and this addition means and the respective DACs constitute mean value data generation means. A control voltage Vcon which is based on the mean value of the respective analog data is generated from the addition circuit 15 which constitutes the addition means.

Figure 1:
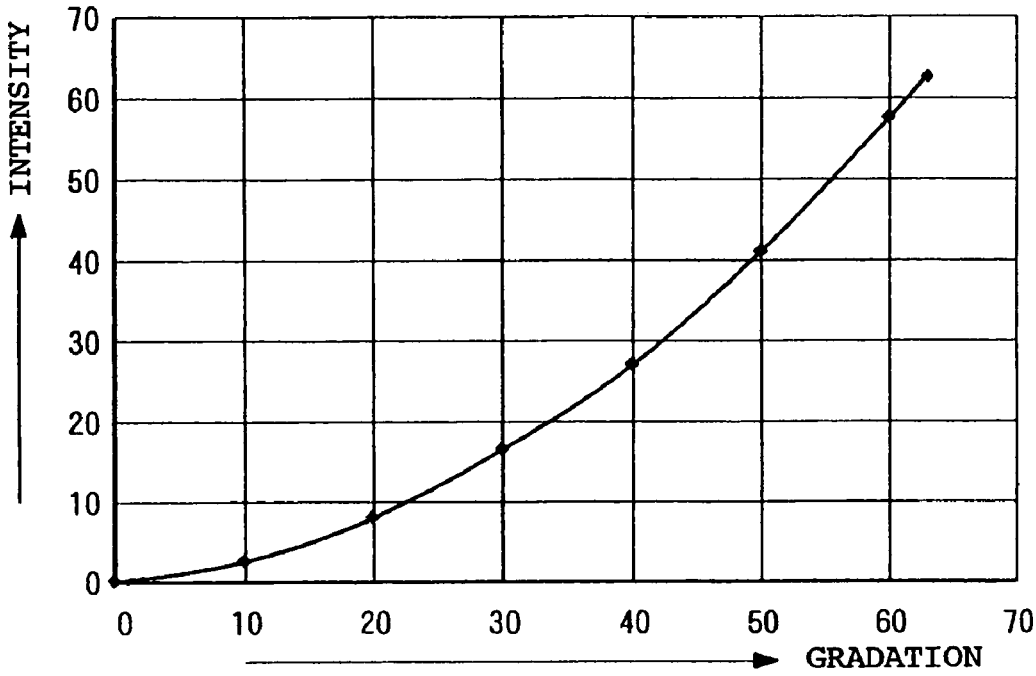
FIG. 1 is a characteristic view showing one example of a γ correction curve suitably adopted in the case where organic EL elements are employed.

Meanwhile, an absorption current a in a current mirror circuit 16 is controlled based on the control voltage Vcon outputted from the addition circuit 15, and thus a light emission drive current a for the EL elements is outputted from the current mirror circuit 16 to Aout for the anode lines A1–An which are shown in FIG. 1 as the data lines. That is, the current mirror circuit 16 achieves the function of the respective constant current sources I1–In in the anode line drive circuit 2 and constitutes drive current supply means.

Figure 5:
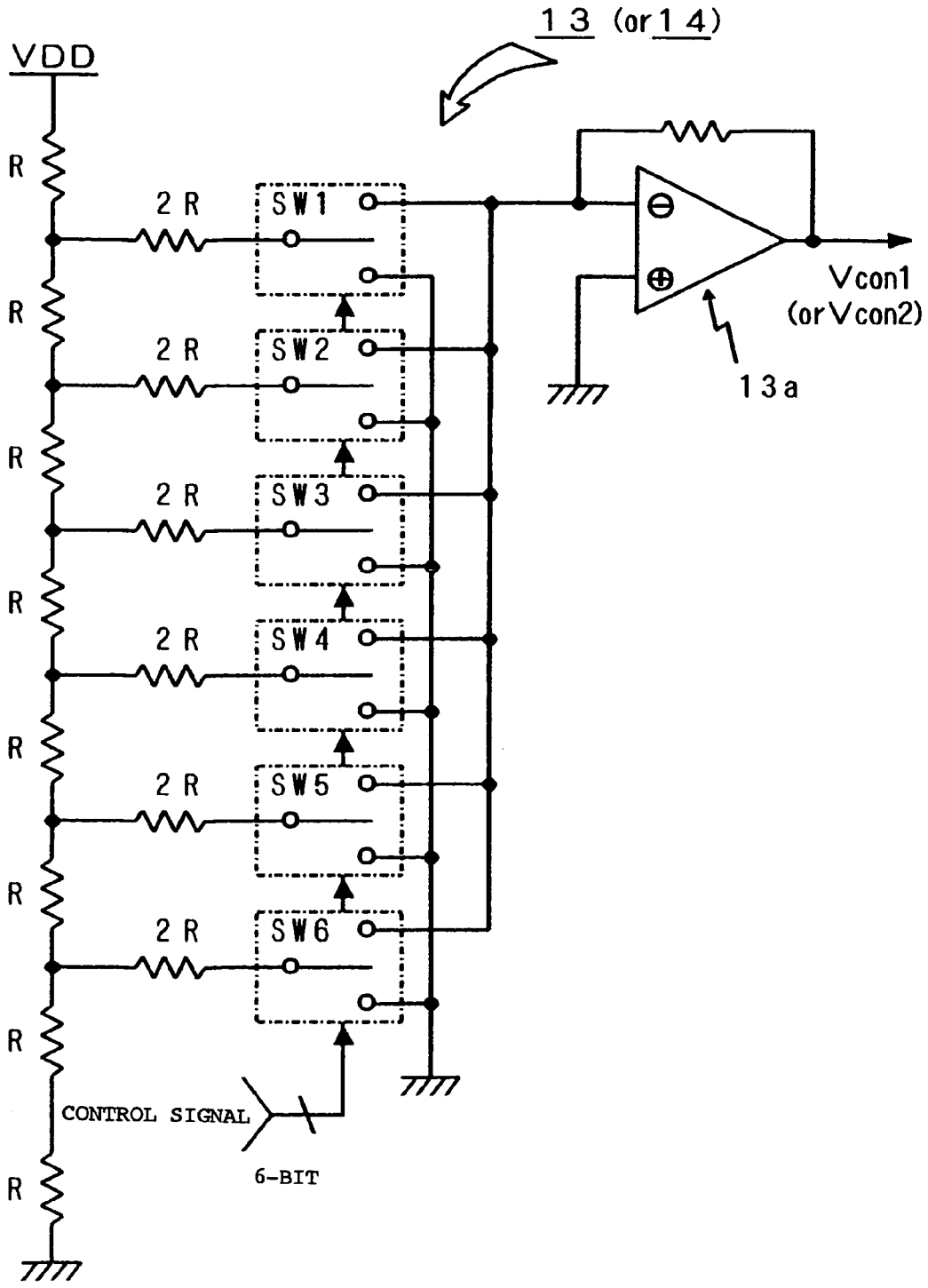
FIG. 5 is a connection diagram showing one preferred example of a DAC which is utilized in the structures shown in FIGS. 3 and 4.

FIG. 5 shows a specific example of the first DAC 13 (or the second DAC 14) shown in FIG. 3. This DAC 13 shows a current additive type DA converter as an example. That is, eight resistors R having the same resistance value are connected in series and are arranged between a power source VDD and ground, and the divided voltage potentials of respective connection points are supplied to select switches SW1–SW6 via resistors 2R which have the same resistance value. The select switches SW1–SW6 are constructed in such a way that the respective divided voltage potentials are supplied to a buffer 13*a* constituted by an op amp or are connected to the ground.

The ON/OFF states of the select switches SW1–SW6 are set by a control signal (a digital quantity), and analog data (analog voltage Vcon1 or Vcon2) is outputted from the buffer 13*a*. The output characteristic of the DAC shown in FIG. 5 is linear, and the intensity conversion data read out of the first or second data table 11, 12 shown in FIG. 3 are utilized for the control signal which performs ON/OFF control of the select switches SW1–SW6.

Figure 6:
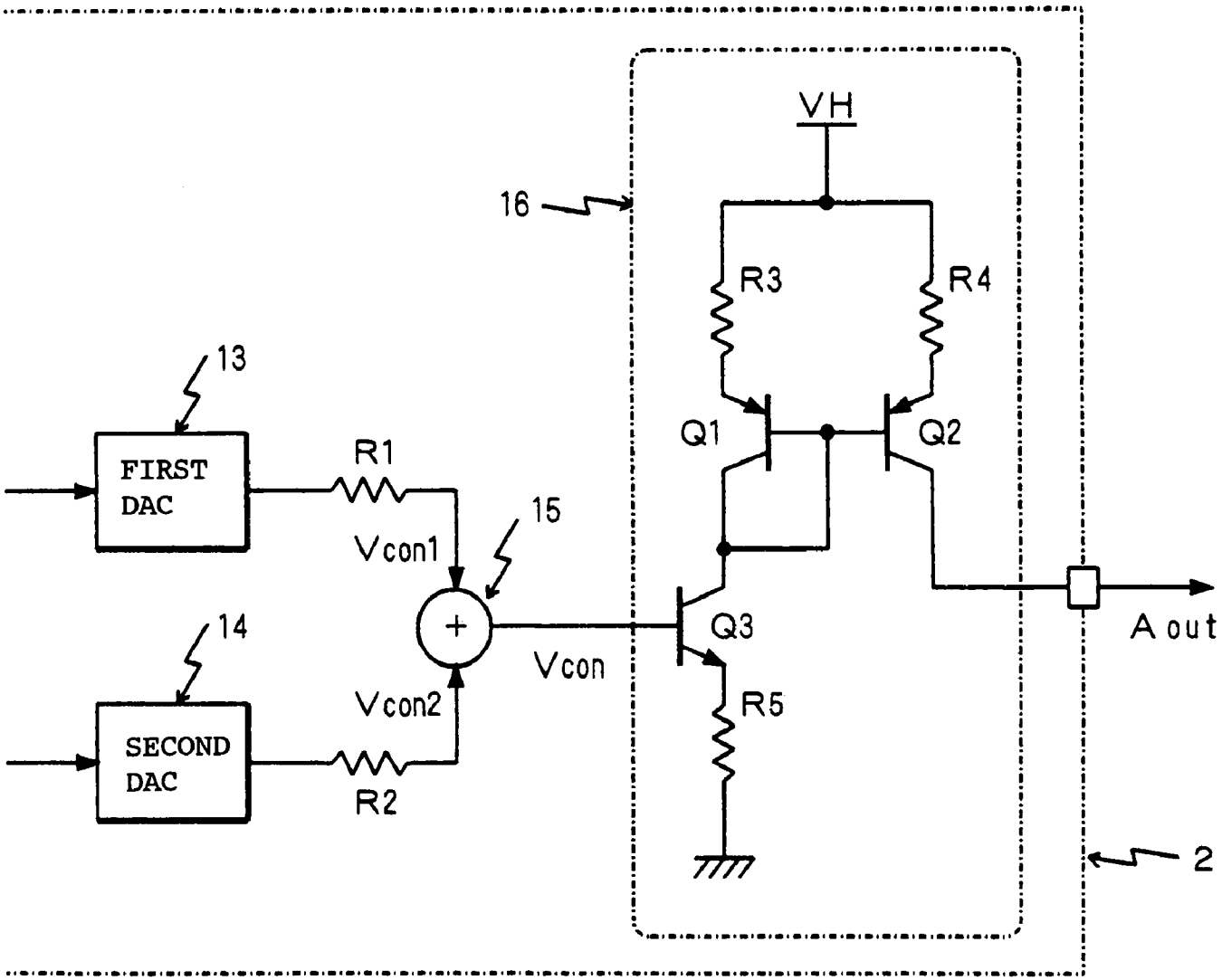
FIG. 6 is a connection diagram showing one preferred example of a current mirror circuit utilized in the structures shown in FIGS. 3 and 4.

FIG. 6 shows an example of the current mirror circuit 16 whose drive current is controlled based on the control voltage Vcon outputted from the addition circuit 15. In this current mirror circuit 16, respective emitters of PNP type transistors Q1 and Q2 are connected via resistors R3 and R4 connected to the drive voltage source VH, and the bases of the respective transistors Q1 and Q2 are commonly connected. The base and collector of the transistor Q1 constituting a current control side are directly connected.

The collector of an NPN type transistor Q3 is connected to the collector of the transistor Q1, and the emitter thereof is connected to the ground via a resistor R5. The control voltage Vcon generated by the display DAC 15 is supplied to the base of the transistor Q3. Therefore, the transistor Q3 constitutes a current absorption circuit which operates by the control voltage Vcon outputted from the addition circuit 15, and current corresponding to the value of the current absorbed by this current absorption circuit is outputted as Aout from the collector of the transistor Q2 by a current mirror effect.

The combination of the transistor Q2 and the load resistor R4 constituting the current mirror circuit 16 corresponds, for example, to the constant current source I1 in the anode line drive circuit 2 shown in FIG. 2, and even other constant current sources I2–In can be realized by the combination of a transistor whose base is commonly connected similarly and a load resistor.

Figure 4:
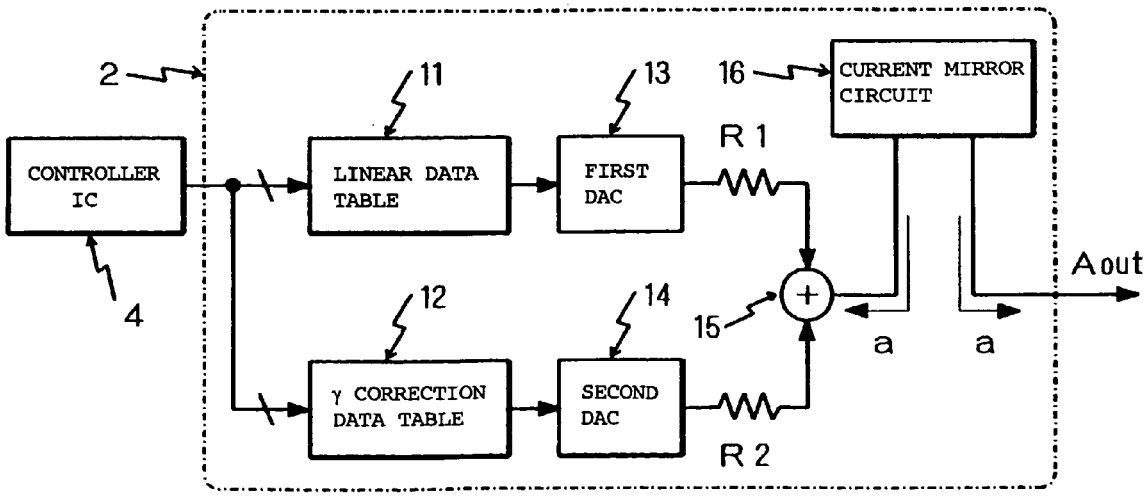
FIG. 4 is a block diagram showing another embodiment according to the present invention.

FIG. 7 shows a specific example of the first data table 11 and the second data table 12 shown in FIG. 3. The most left column shown in this FIG. 7 shows gradations whose light emission is controlled, and here, 64 gradations of "gradation 0" through "gradation 63" are provided. A right side column thereof shows the intensity conversion data stored in the first data table 11 (Table 1), and in the example shown in this FIG. 7, data is arranged such that light emission control by linear gradation is executed corresponding to the gradations shown in the left side column thereof. That is, intensity conversion data (t1) stored in Table 1 corresponding to "gradation 0" through "gradation 63" also are made as "0" through "63", A further right side column thereof (Table 2) in FIG. 7 corresponds to intensity conversion data (t2) stored in the second data table 12 which realizes gradation control accompanied by γ correction by a mean value with the intensity conversion data stored in Table 1, and this column can also be said to be a γ correction data table. That is, the combination of the first and second data tables 11, 12 shown in FIG. 7 can be described as a combination structure of the linear data table 11 and the γ correction data table 12 shown in FIG. 4.

A further right side column thereof in FIG. 7 shows mean values of the intensity conversion data obtained by Table 1 and Table 2. That is, this can be said to be analog data corresponding to the control voltage Vcon outputted from the addition circuit 15. A further right side column thereof in FIG. 7 shows ideal γ correction values, that is, intensity values in response to the gradations. The most right column shows "differences" between the mean values and the γ correction values. Therefore, it can be said that the closer to "0" the absolute values of the "differences", the closer to the ideal γ correction values the mean values are.

The intensity conversion data shown in Table 1 and Table 2 shown in FIG. 7, although being shown by analog quantities by numerals for convenience of explanation, are all constituted by simple integer data with two or less digits. Therefore, control operations thereof can be simplified also without increasing the circuit scale of the first DAC 13 and the second DAC 14 driven by digital data already explained. As a result, as shown by the mean values, values close to the ideal γ correction values can be obtained.

FIG. 8 shows a second specific example of the data tables. The arrangement relationship shown in this FIG. 8 is the same as that shown in FIG. 7. It can be understood that according to the intensity conversion data shown in Table 1 in this FIG. 8, light emission control by linear gradation is not necessarily executed in a low gradation area, and the mean values thereof are made more close to the ideal γ correction values by combination with the intensity conversion data stored in Table 2.

As described above, with the drive device of a light emitting display panel according to the present invention, respectively different plural intensity conversion data are extracted in response to a gradation whose light emission is controlled, and these are converted into analog data by the respective DACs, whereby by the mean value thereof, a drive current for light emitting elements accompanied by γ correction is obtained. At this time, since a mean value of a plurality of intensity conversion data is acquired, relatively simple intensity conversion data can be handled respectively. Accordingly, a light emission control circuit accompanied by γ correction can be realized without increasing the circuit scales of the respective DACs.

In the embodiments described above, although organic EL elements are employed as light emitting elements, for the elements, other light emitting elements whose light emission intensities are dependent on the drive current can also be employed. Further, in the embodiments shown in FIGS. 3 and 4, although two tables designated by reference numerals 11 and 12 are utilized, three or more tables can also be utilized.

What is claimed is:

1. A drive device of a passive matrix type light emitting display panel comprising a plurality of data lines and a plurality of scan lines which intersect one another and light emitting elements which are respectively connected between the respective data lines and the respective scan lines at intersection positions between the respective data lines and the respective scan lines, characterized by comprising a plurality of intensity conversion data acquisition means for acquiring a combination of respectively different intensity conversion data in response to a gradation whose light emission is controlled, mean value data generation means for generating a mean value of the intensity conversion data respectively acquired by the respective intensity conversion data acquisition means, and drive current supply means for supplying a light emission drive current which can perform gradation control including γ correction for the light emitting elements to the data lines based on mean value data obtained by the mean value data generation means.

2. The drive device of the light emitting display panel according to claim 1, characterized in that the plurality of intensity conversion data acquisition means are constituted by two intensity conversion data acquisition means and that one intensity conversion data acquisition means thereof is constructed such that intensity conversion data by which a relationship of linear gradation is made in response to a gradation whose light emission is controlled can be acquired.

3. The drive device of the light emitting display panel according to claim 1, characterized in that the plurality of intensity conversion data acquisition means are constituted by a plurality of data tables which respectively store mutually different intensity conversion data in response to a gradation whose light emission is controlled and that the mean value data generation means is composed of a plurality of DACs which convert the respective intensity conversion data read out of the respective data tables into analog data and addition means for yielding a mean value of respective analog data obtained by the respective DACs.

4. The drive device of the light emitting display panel according to claim 2, characterized in that the plurality of intensity conversion data acquisition means are constituted by a plurality of data tables which respectively store mutually different intensity conversion data in response to a gradation whose light emission is controlled and that the mean value data generation means is composed of a plurality of DACs which convert the respective intensity conversion data read out of the respective data tables into analog data and addition means for yielding a mean value of respective analog data obtained by the respective DACs.

5. The drive device of the light emitting display panel according to claim 3, characterized in that the plurality of data tables are constituted by two data tables and that one data table thereof stores intensity conversion data by which a relationship of linear gradation is made in response to a gradation whose light emission is controlled.

6. The drive device of the light emitting display panel according to claim 4, characterized in that the plurality of data tables are constituted by two data tables and that one data table thereof stores intensity conversion data by which a relationship of linear gradation is made in response to a gradation whose light emission is controlled.

7. The drive device of the light emitting display panel according to any one of claims 1 to 6, characterized in that the drive current supply means is constructed so as to control an absorption current of a current mirror circuit based on the mean value data obtained by the mean value data generation means and that the light emission drive current which is supplied to the data lines for the light emitting elements is controlled by the current mirror circuit.

8. The drive device of the light emitting display panel according to any one of claims 1 to 6, characterized in that the light emitting element constituting the light emitting display panel is an organic EL element in which an organic material is employed in a light emitting layer.

9. The drive device of the light emitting display panel according to claim 7, characterized in that the light emitting element constituting the light emitting display panel is an organic EL element in which an organic material is employed in a light emitting layer.

10. A drive method of a passive matrix type light emitting display panel comprising a plurality of data lines and a plurality of scan lines which intersect one another and light emitting elements which are respectively connected between the respective data lines and the respective scan lines at intersection positions between the respective data lines and the respective scan lines, characterized by acquiring a combination of respectively different intensity conversion data set in advance in response to a gradation whose light emission is controlled, generating data of a mean value of these respective intensity conversion data set from the respective intensity conversion data set, and supplying a light emission drive current which can realize gradation control including $\gamma$ correction for the light emitting elements based on the data of the mean value.

* * * * *